US006045296A

United States Patent [19]

Otten et al.

[11] Patent Number: 6,045,296

[45] Date of Patent: Apr. 4, 2000

[54] TENSION RING FOR RISER

[75] Inventors: Jeffrey Douglas Otten, Cypress; Chenteh Alan Yu, Houston, both of Tex.

[73] Assignee: ABB Vetco Gray Inc., Houston, Tex.

[21] Appl. No.: 08/675,983

[22] Filed: Jul. 9, 1996

[51] Int. Cl.[7] ..... E02B 17/00; E02D 21/00; B63B 7/128

[52] U.S. Cl. ..... 405/195.1; 166/350; 166/359; 405/223.1; 405/224.4

[58] Field of Search ..... 405/195.1, 224.4, 405/223.1; 166/350, 359, 367, 243

[56] References Cited

U.S. PATENT DOCUMENTS

| | | | |
|---|---|---|---|
| 3,067,820 | 12/1962 | Green | 166/243 X |
| 4,167,279 | 9/1979 | Lucksinger | 166/305 X |
| 4,291,767 | 9/1981 | Hall | 166/243 X |
| 4,428,433 | 1/1984 | Watkins . | |
| 4,733,991 | 3/1988 | Myers . | |
| 4,799,827 | 1/1989 | Jaqua . | |
| 4,818,147 | 4/1989 | Rasmussen | 405/195.1 X |
| 4,840,194 | 6/1989 | Berry . | |
| 4,883,387 | 11/1989 | Myers et al. . | |
| 5,310,007 | 5/1994 | Parikh . | |
| 5,482,406 | 1/1996 | Arlt | 405/195.1 |
| 5,522,681 | 6/1996 | Pallini | 405/223.1 |

*Primary Examiner*—Dennis L. Taylor
*Attorney, Agent, or Firm*—James E. Bradley

[57] ABSTRACT

A tensioning device is provided for applying tension to a riser from a surface deck of an offshore oil or gas well. The tensioning device is used with a riser of the type having threads formed on an exterior surface thereof. A tension ring of the tensioning device is formed from first and second ring halves that are clamped together about the riser. The first and second halves have inner threads for engaging the threads of the riser. A clearance exists between the first and second ring halves when the ring halves are clamped together about the riser to allow the first and second ring halves to be tightened against the exterior surface of the riser so that the tension ring is securely fastened to the riser. Fastening means are used for clamping the first and second ring halves together about the riser. Tensioning members that couple at one end to the tension ring and at the other end to the surface deck are used to apply tension to the riser from the surface deck.

16 Claims, 3 Drawing Sheets

TENSION RING FOR RISER

BACKGROUND OF THE INVENTION

1. Field of the Invention

This invention relates in general to offshore oil and gas well equipment and in particular to a coupling for a subsea riser to a platform or surface deck.

2. Description of the Prior Art

In offshore oil and gas wells, a pipe, often referred to as a riser, is used for communicating between the wellhead, located at the sea bottom, and the surface. The riser is supported at one end from a floating platform, or other surface structure, and is coupled at the other end to the subsea wellhead. Because of movement of the surface platform caused by wave motion and ocean currents, the riser must be coupled to the surface platform in a manner that allows for this movement while maintaining adequate tension on the riser. This is typically accomplished through the use of tensioners that couple between the platform and riser. The tensioner is usually in the form of a piston and cylinder containing pressurized fluid. The piston and cylinder are coupled to the riser by means of a tension ring. Most prior art tension rings are formed as a unitary ring which surrounds the riser.

The upper section of the riser is typically provided with helical threads for engagement with threads of the tension ring itself, or locking members or wedges used to retain the tension ring in place upon the riser. Those tension ring assemblies that do employ locking members, slips or wedges, besides adding to the number of parts that must be manufactured and machined, also require the tension ring to have a larger diameter for accommodating locking members.

It is often necessary to adjust the position of the tension ring along the riser. This is accomplished by rotating the threaded tension ring or the locking member assembly upon the threaded riser so that the tension ring can be moved to the desired position along the riser. Oftentimes, especially after extended periods of use without adjustment, the threads of the riser and tension ring assembly may tend to seize together making it difficult to rotate the threaded tension ring or locking member assembly. Damage and deformation of exposed threads of the riser may also make rotation difficult as the tension ring assembly is moved along the riser.

What is therefore needed is an improved riser tensioner and tensioning ring that is simple in design, is easily constructed and that can be positioned or repositioned on the riser and which does not require the need for locking members or slips that increase the required diameter of the tension ring or necessitate the manufacturing of additional components.

SUMMARY OF THE INVENTION

A tensioning device is provided for applying tension to a riser from a deck structure of an offshore oil or gas well. The tensioning device is used with a riser of the type having threads formed on an exterior surface thereof. A tension ring of the tensioning device is formed from first and second ring halves that are clamped together about the riser. The first and second halves have inner threads for engaging the threads of the riser. A clearance exists between the first and second ring halves when the ring halves are clamped together about the riser to allow the first and second ring halves to be tightened against the exterior surface of the riser so that the tension ring is securely fastened to the riser. Fastening means are used for clamping the first and second ring halves together about the riser. At least one tensioning member that couples at one end to the tension ring and at the other end to the deck structure is used to apply tension to the riser from the surface deck.

In a preferred embodiment, the tension ring halves are formed together from a unitary piece of material having a hole that defines an inner surface and that is sized to closely receive the riser. The inner threads are formed on the inner surface of the hole with the unitary piece of material being cut in half to form the first and second halves.

DETAILED DESCRIPTION OF THE INVENTION

Figure 1:
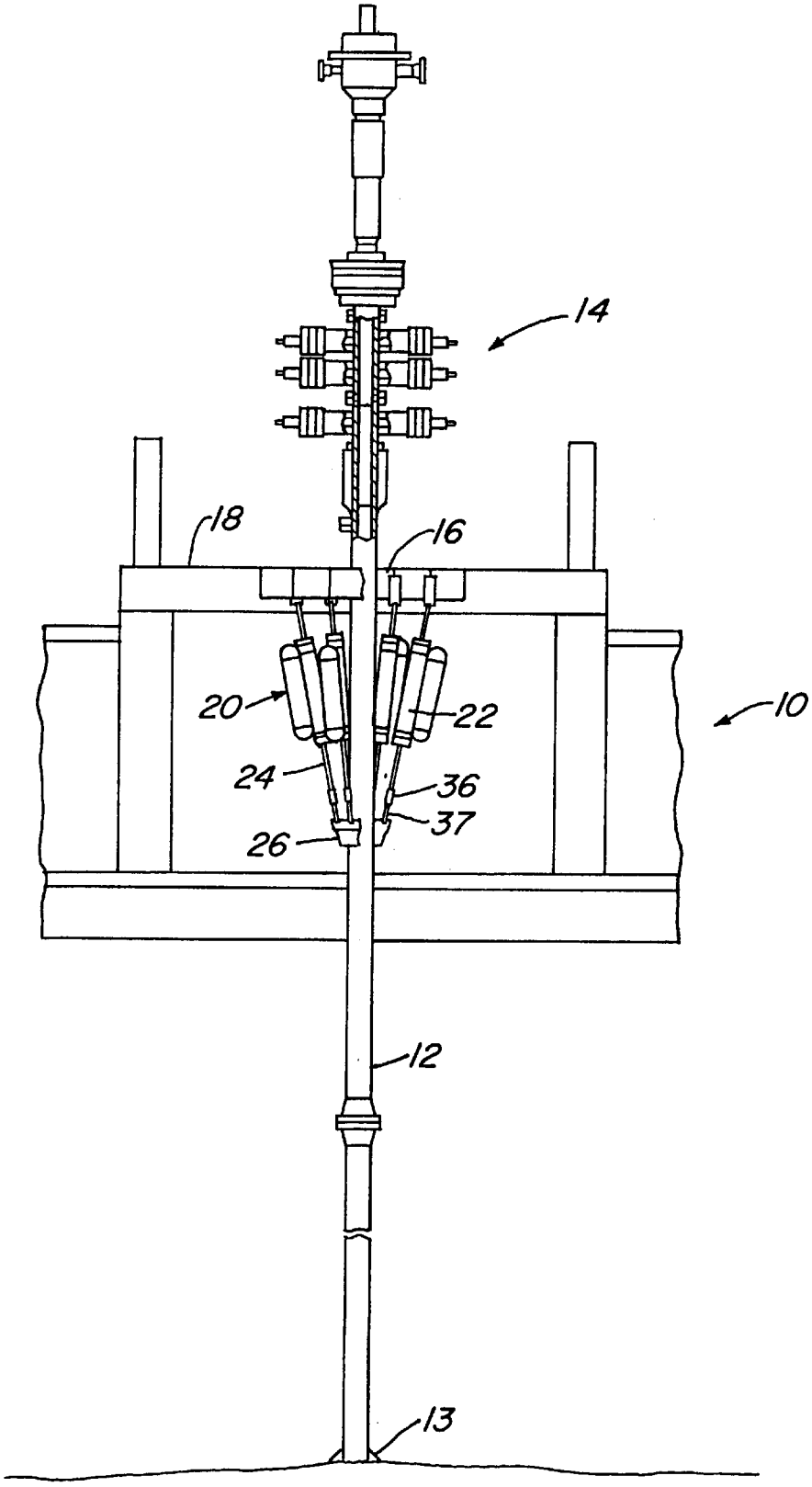
FIG. 1 is a side view of an offshore platform used on an oil or gas well shown with a riser coupled to the platform by means of a riser tensioner constructed in accordance with the invention.

Referring now to the figures, FIG. 1 shows an offshore well platform designated generally at 10 used in the production or drilling of oil and gas wells. A riser 12 is connected at its lower end to the wellhead 13 located on the sea floor, and at its upper end to a surface wellhead or Christmas tree 14. A hole 16 located in a deck 18 of the platform 10, through which the riser 12 extends, allows for relative movement of the platform 10 and riser 12, such as that caused by wave motion and ocean currents.

The upper end of the riser 12 is coupled to the deck 18 of the platform 10 by means of riser tensioners 20. The riser tensioners 20 may consist of hydraulic or pneumatic piston and cylinder. It should be apparent to those skilled in the art, however, that the riser tensioner 20 could include a variety of devices, such as a cable or line mounted on tensioning winches. As shown in FIG. 1, the upper end of cylinder 22 of the tensioner 20 is coupled to the deck 18 and rod 24 is coupled to the riser 12 by means of a tension ring or collar 26, which will now be described in detail.

Figure 2:
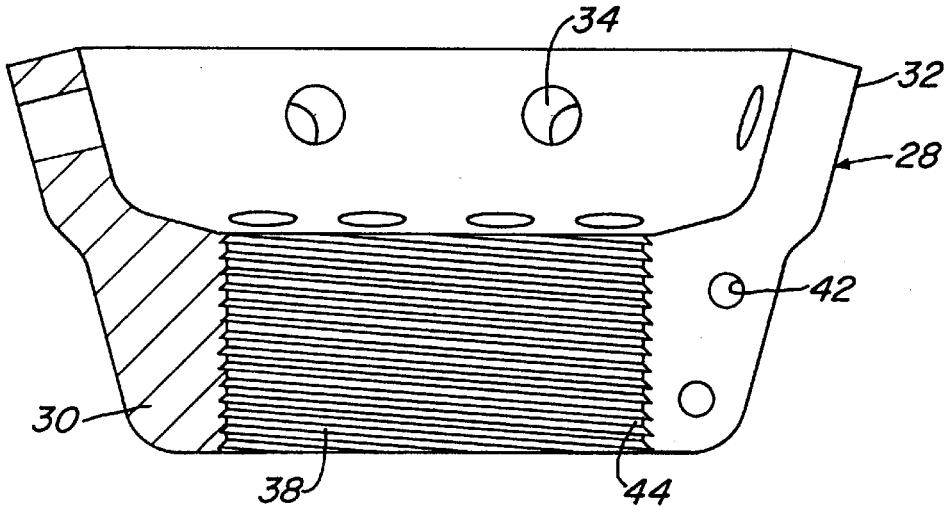
FIG. 2 is a cross-sectional view of the tension ring of FIG. 3 taken along the lines II—II, and constructed in accordance with the invention.
Figure 3:
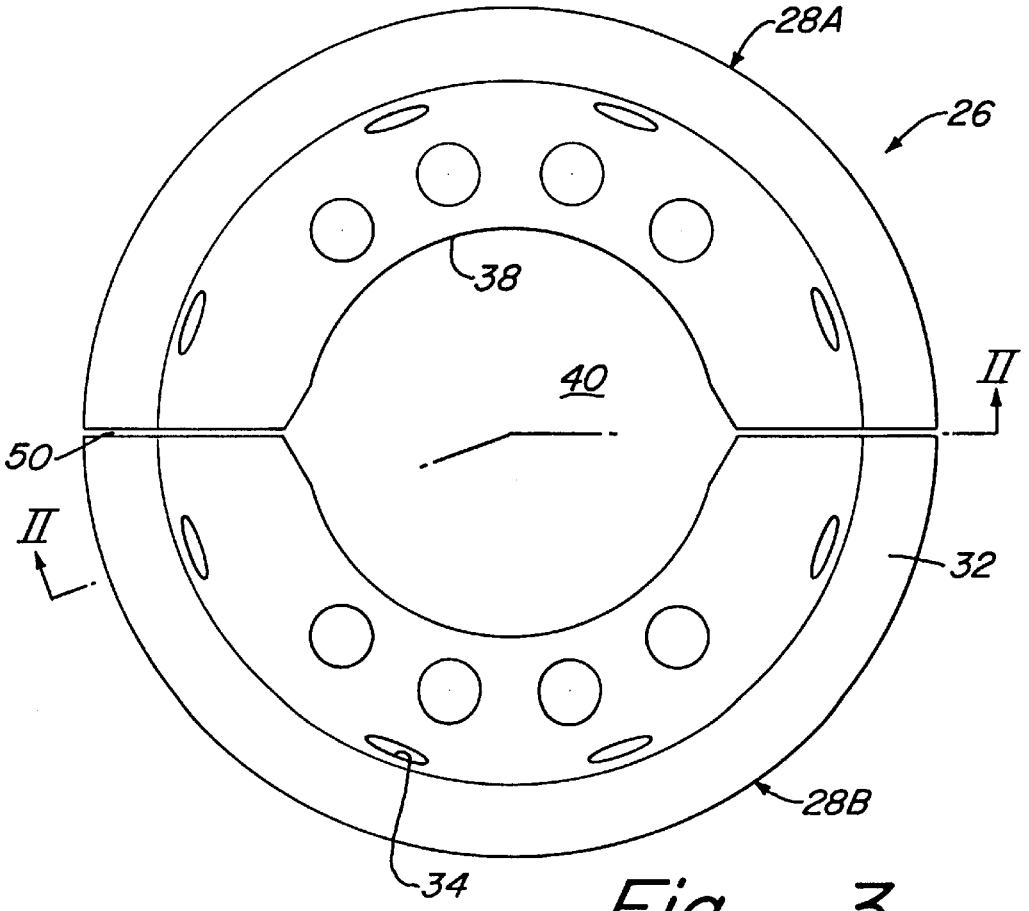
FIG. 3 is a top plan view of a tension ring constructed in accordance with the invention.

Referring to FIGS. 2 and 3, the tension ring 26 is composed of two separate ring halves 28A, 28B, which are generally configured the same and cooperate with one another to form the ring 26. For ease of description, reference to element 28 without designation will encompass both ring halves 28A, 28B. Each ring half 28 is provided with a riser engagement portion 30 and an upward extending flange 32.

The flange 32 is provided with several holes or eyelets 34 for coupling to the rod 24 of the tensioner 20. This may be accomplished by providing a hook 36 (FIG. 1) with the rod 24 and providing shackles 37 that couple to the eyelets 34. The eyelets 34 are evenly spaced about the entire flange 32, either individually or in pairs as required by the number of tensioner elements needed, so that several tensioners 20 may be attached to the ring 28.

The riser engagement portion 30 is provided with an arcuate recess 38 that, when the ring halves 28A, 28B are matched together, forms a circular, central hole 40 of the ring 26 for receiving the riser 12. Bolt holes 42 are formed on either side of the recess 38.

Helical inner threads 44 are formed on the surface of arcuate recess 38. The inner threads 44 of ring half 28A should align with those of ring half 28B when the ring halves 28 are clamped together, as will be discussed.

Figure 4:
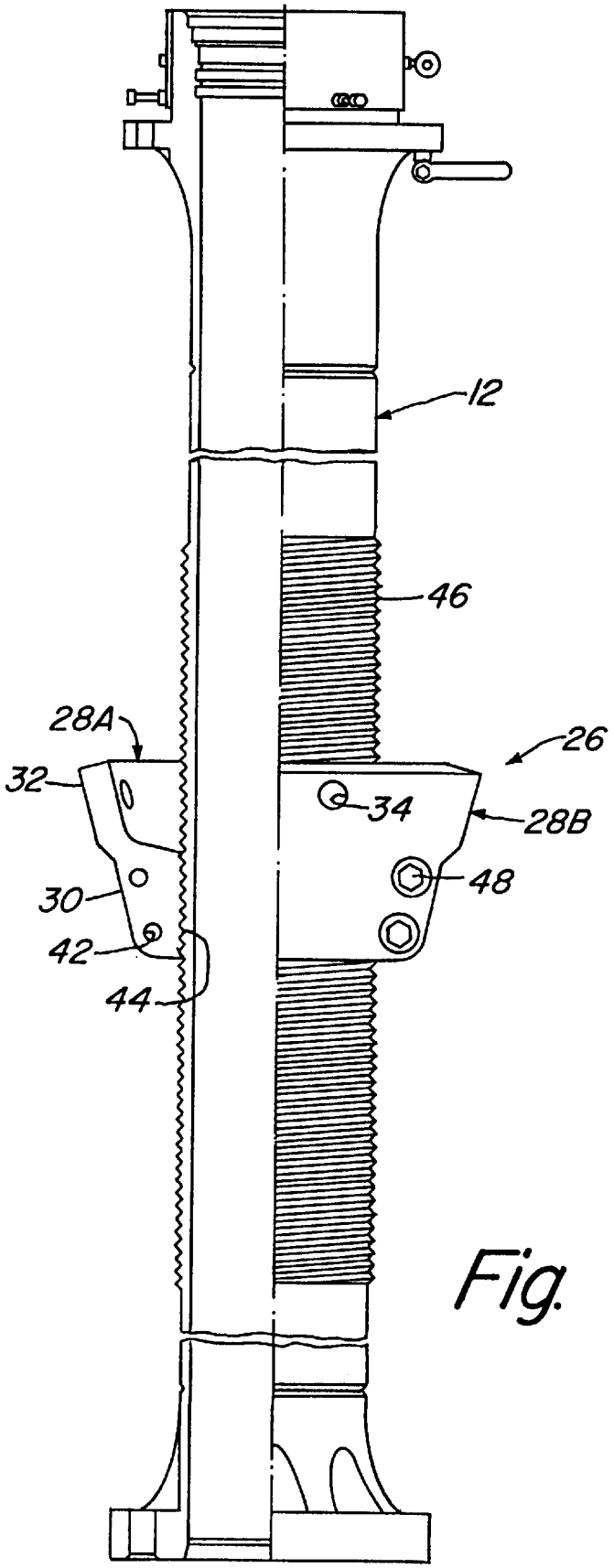
FIG. 4 is a partially sectioned side view of a riser shown with the tension ring coupled thereto in accordance with the invention.

The upper end of the riser 12 is also provided with helical threads 46 (FIG. 4) for engaging the threads 44 of the tension ring 26.

Bolts or fasteners 48, which are passed through the bolt holes 42, are used to clamp the ring halves 28A, 28B together about the threaded portion of the riser 12. A length of all-thread with threaded nuts at either end is particularly well suited for the fasteners 48. The length of the bolts 48 should be great enough to allow the ring halves 28A, 28B to be loosened about the riser 12 without uncoupling the ring halves 28A, 28B.

Preferably, the tension ring 26 is formed from a metal casting or forging as a single piece, complete with the eyelets 34, central hole 40 and bolt holes 42. The threads 44 may also be formed during casting or forging. If necessary, the threads may be further machined or tapped to remove burrs or imperfections as a result of the casting or forging. The threads 44 should be formed while the tension ring 26 is still whole to ensure that the threads 44 of each half 28A, 28B are properly aligned with each other.

After the ring 26 is cast or forged and the threads 44 are formed, the tension ring 26 is cut in half along a plane that runs through to the central axis of the ring 26 so that the ring 26 is divided into the halves 28A, 28B. Preferably, this is accomplished by a method, such as sawing, whereby a portion of the material making up ring 26 is removed. In this way a slight clearance 50 is created between the two halves 28A, 28B so that the halves 28 can be tightly clamped together about the riser 12.

To mount the tension ring 26 on the riser 12, the halves 28A, 28B are aligned on either side of the riser 12 and brought together so that the helical threads 44 of the ring halves 28 engage the threads 46 of the riser 12. The bolts 48, passed through the bolt holes 42, are then tightened. As discussed, the clearance 50 allows the ring halves 28A, 28B to be clamped together tightly in a non-abutting relationship against the exterior surface of the riser 12. By tightly clamping the ring halves 28A, 28B together, a preload is created on the tension ring 26, resulting in a lower stress range and a higher fatigue life, as compared to a non-preloaded tension ring.

For minor adjustments in position of the tension ring 26 upon the riser 12, the bolts 48 are loosened slightly without uncoupling them so that the tension ring 26 can be rotated about the riser 12, thus moving the ring 26 axially along the riser 12 by means of the helical threads 46. For major adjustments, the ring halves 28A, 28B are unbolted completely. The halves 28A, 28B are then separated, repositioned along the riser 26 and brought back together in aligned relationship and rebolted.

The tensioning device of the invention has several advantages. The tension ring is simple in construction. Because the tension ring is formed in two halves that are bolted together, the tension ring can be loosened from around the riser, allowing the ring to be easily threaded along the riser for minor adjustments in position. This construction also allows the ring halves to be separated completely for major adjustments in position along the riser without threading. This also allows the tension ring to be used on different risers without having to disconnect the riser or remove flanges or other structures as would be required with a one-piece tension ring.

Because the threads are formed on the ring halves themselves, there is no need for separate slips or wedges. This allows the tension ring to have a smaller diameter and eliminates the need for additional components that must be manufactured and machined.

The clearance created when cutting the ring in half allows the two halves to be brought together and tightened about the riser so that the ring is tightly secured to the riser and a preload is created on the tension ring. This reduces the stress range and increases the fatigue life of the tension ring when subjected to loads from the tensioner.

While the invention has been shown in only one of its forms, it should be apparent to those skilled in the art that it is not so limited, but is susceptible to various changes without departing from the scope of the invention.

We claim:

1. A tensioning device for applying tension to a riser from a deck structure of an offshore oil or gas well, the riser having threads formed on an exterior surface thereof, the tensioning device comprising;

a tension ring formed from first and second ring halves that are clamped together about the riser, the first and second halves having inner threads for engaging the threads of the riser, and wherein a clearance exists between the first and second ring halves when the ring halves are clamped together about the riser to allow the first and second ring halves to be tightened against the exterior surface of the riser so that the tension ring is securely fastened to the riser;

fastening means for clamping the first and second ring halves together about the riser; and at least one tensioning member that couples at one end to the tension ring and at the other end to the deck structure to thus apply tension to the riser from the deck structure.

2. The tensioning device of claim 1, wherein:

the tension ring has coupling means for coupling said one end of the tensioning member to the tension ring.

3. The tensioning device of claim 2, wherein:

the coupling means is a pad integrally formed with the tension ring, the pad having an aperture for engaging the tensioning member.

4. The tensioning device of claim 1, wherein:

the tension ring halves are both formed together from a unitary piece of material having a hole defining an inner surface and sized to closely receive the riser, the inner threads being formed on the inner surface, the unitary piece of material being cut in half to form the first and second halves.

5. The tensioning device of claim 4, wherein:

an amount of material is removed from cutting the unitary piece of material in half to provide the clearance between the first and second halves when the ring halves are clamped together about the riser.

6. The tensioning device of claim 1, wherein:

the fastening means is adjustable to allow the first and second ring halves to be tightened and loosened about the riser thus allowing the tension ring to be repositioned on the riser.

7. The tensioning device of claim 1, wherein:

the tensioning member is a piston and cylinder.

8. A tensioning device for applying tension to a riser from a deck structure of an offshore oil or gas well, the riser having threads formed on an exterior surface thereof, the tensioning device comprising;

a tension ring formed from first and second ring halves that are clamped together about the riser, the first and second halves having inner threads for engaging the threads of the riser, and wherein a clearance exists between the first and second ring halves when the ring halves are clamped together about the riser to allow the first and second ring halves to be tightened against the exterior surface of the riser so that the tension ring is securely fastened to the riser, and wherein the tension ring halves are both formed together from a unitary piece of material having a hole defining an inner surface and sized to closely receive the riser, the inner threads being formed on the inner surface, the unitary piece of material being cut in half to form the first and second halves;

fastening means for clamping the first and second ring halves together about the riser; and at least one tensioning member that couples at one end to the tension ring and at the other end to the deck structure to thus apply tension to the riser from the deck structure.

9. The tensioning device of claim 8, wherein:

the tension ring has coupling means for coupling said one end of the tensioning member to the tension ring.

10. The tensioning device of claim 9, wherein:

the coupling means is a pad integrally formed with the tension ring, the pad having an aperture for engaging the tensioning member.

11. The tensioning device of claim 8, wherein:

an amount of material is removed from cutting the unitary piece of material in half to provide the clearance between the first and second halves when the ring halves are clamped together about the riser.

12. The tensioning device of claim 8, wherein:

the fastening means is adjustable to allow the first and second ring halves to be tightened and loosened about the riser thus allowing the tension ring to be repositioned on the riser.

13. The tensioning device of claim 8, wherein:

the tensioning member is a piston and cylinder.

14. A method of tensioning a riser from a deck structure of an offshore oil or gas well, the riser having threads formed on an exterior surface thereof, the method comprising;

providing a tension ring formed from first and second ring halves that clamp together about the riser, the first and second halves having inner threads for engaging the threads of the riser;

providing a clearance between the first and second ring halves when the ring halves are clamped together about the riser to allow the first and second ring halves to be tightened against the exterior surface of the riser;

positioning the first and second ring halves along the riser at a desired location;

clamping the first and second ring halves together about the riser at the desired location so that the ring halves are in tight engagement with the riser; and coupling one end of a tensioning member to the tension ring and the other end of the tensioning member to the deck structure so that tension is applied to the riser from the deck structure.

15. The method of claim 14, wherein the tension ring is provided by:

providing a unitary piece of material having a hole defining an inner surface and sized to closely receive the riser;

forming the inner threads on the inner surface of the hole; and then cutting the unitary piece of material in half to form the first and second ring halves.

16. The tensioning device of claim 14, wherein:

an amount of material is removed from cutting the unitary piece of material in half to provide the clearance between the first and second halves when the ring halves are clamped together about the riser.

* * * * *